United States Patent [19]

Rodriguez

[11] 4,198,001

[45] Apr. 15, 1980

[54] CONTROLLED THRUST, ROTARY, ADJUSTABLE TOPOGRAPHY SPRINKLER

[76] Inventor: Ricardo A. Rodriguez, 39 Suffolk Ave., Hialeah, Fla. 33010

[21] Appl. No.: 894,928

[22] Filed: Apr. 10, 1978

[51] Int. Cl.[2] ..... B05B 3/06

[52] U.S. Cl. ..... 239/227; 239/236; 239/252

[58] Field of Search ..... 239/227, 236, 252, 255, 239/261

[56] References Cited

U.S. PATENT DOCUMENTS

| | | | |
|---|---|---|---|
| 1,733,249 | 10/1929 | Clinton | 239/255 |
| 1,962,308 | 6/1934 | Jacobson | 239/255 X |
| 3,642,208 | 2/1972 | Guth | 239/255 |
| 3,878,990 | 4/1975 | Geraudie | 239/236 |
| 3,952,954 | 4/1976 | Taylor | 239/236 |

*Primary Examiner*—John J. Love
*Attorney, Agent, or Firm*—Jack E. Dominik

[57] ABSTRACT

The present invention of a rotary type irrigation device, relates to devices which achieve the irrigation of other than circular patterns, by controlling the range of the irrigation jet. The irrigation device harnesses the thrust induced by its irrigation jet to power all intrinsic motions.

7 Claims, 11 Drawing Figures

CONTROLLED THRUST, ROTARY, ADJUSTABLE TOPOGRAPHY SPRINKLER

BACKGROUND OF THE INVENTION

This invention pertains to irrigation devices capable of varying their irrigation patterns. The invention particularly relates to those which achieve the desired patterns through the circular motion of an irrigation jet, whose range is controlled by varying its angle of elevation as illustrated in U.S. Pat. Nos. 2,979,271 and 3,091,399. The above mentioned references describe apparatus which respectively utilize nonadjustable cylindrical cams and flat interchangeable cam plates to position the nozzle's angle of elevation as the device is caused to rotate circularly by internal mechanisms. The disclosed apparatus of the references utilize part of the kinetic energy in the water and transforms it into the mechanical energy need to provide the necessary rotation. In addition to the introduction of an adjustable contour plate to perform the functions said cylindrical cams and cam plates, in the present invention all internal mechanisms have been eliminated, a minimal number of parts are required and uniform water distribution is closely achieved. Also pertinent is U.S. Pat. No. 3,960,327 which attempts to provide an adjustable contour surface through use of a flexible or elastomeric material frictionally engaged between an annular channel.

SUMMARY OF THE INVENTION

The present invention stems from the utilities to be lent to nurseries, the farming industry and lawn lovers, etc., from an adjustable device capable of irrigating areas of other than, as well as, circular configurations. Recognizing that any device facilitating this utility would be impractical if it required numerous moving parts in intricate arrangements, and if setting of the desired patterns were difficult, the present invention achieves the desired effects through the use of only five major moving parts arranged about a central hollow cylindrical frame. Two parts comprise the main irrigation mechanism; a hollow rotary unit that holds a rotary nozzle, and the nozzle which is mounted on the rotary unit at a slight radial distance from its axis of rotation and in a manner such that the irrigation jet thrust produces a rotating torque on the hollow rotary unit. Two other parts comprise the main mechanisms for harnessing and controlling the resultant force of irrigation jet and its induced torque, a torque buffing impeller and its connecting means to the rotary unit. An additional moving part, a nozzle rotation restrainer mounted on the hollow rotary unit acts on the nozzle to restrain its rotation during particular motions. A fixed one piece adjustable contour plate consists essentially of the contour surface, which via a contact leg extending from the nozzle and riding on its surface its contour variations are transmitted into nozzle rotation.

THE DRAWINGS

FIG. 1 is an exploded perspective view of the device showing the relationship between all its components.

FIG. 1*a* is an exploded perspective view of the frame, contour plate, and nut.

DETAILED DESCRIPTION OF A PREFERRED EMBODIMENT

Figure 1:
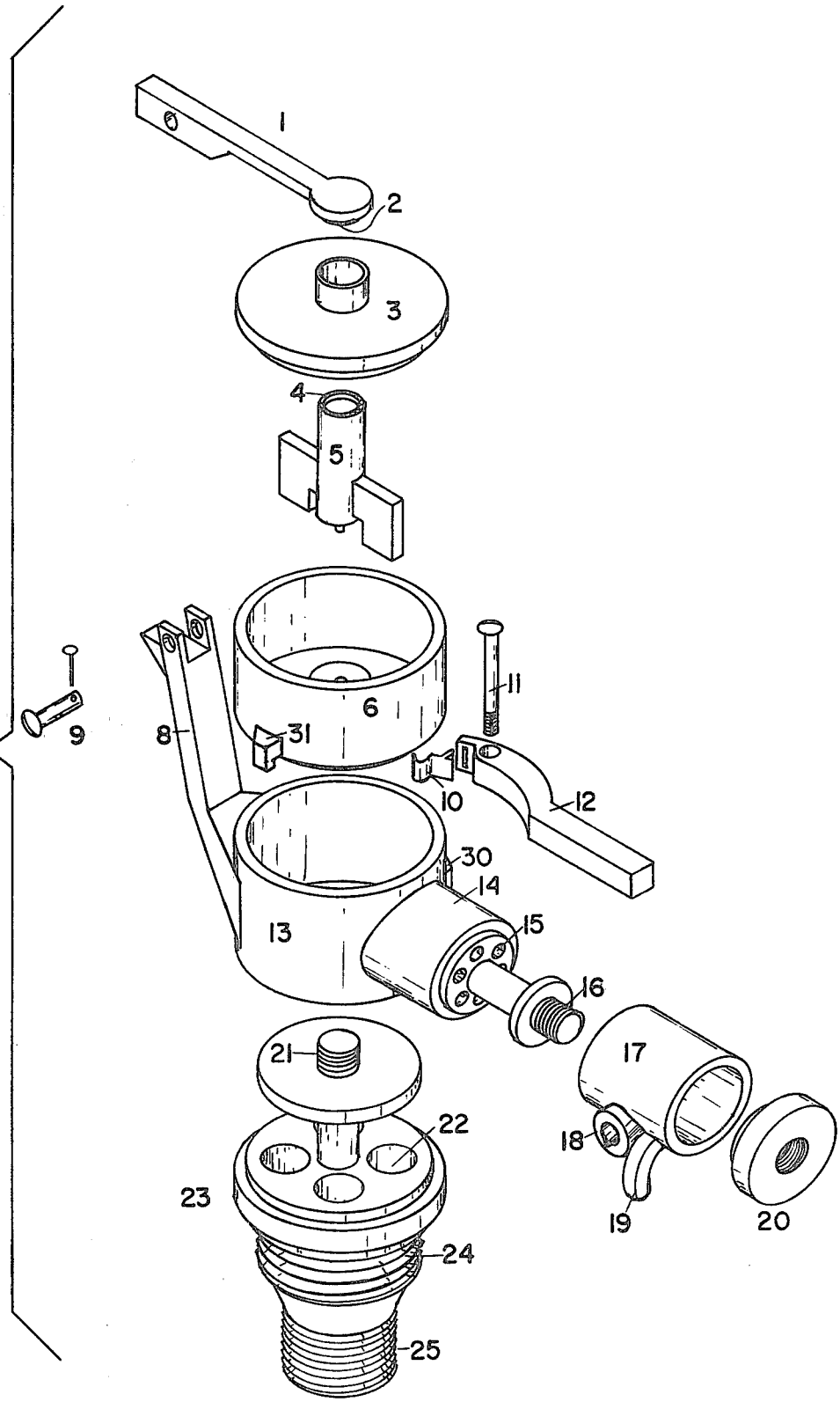
Figure 1A:
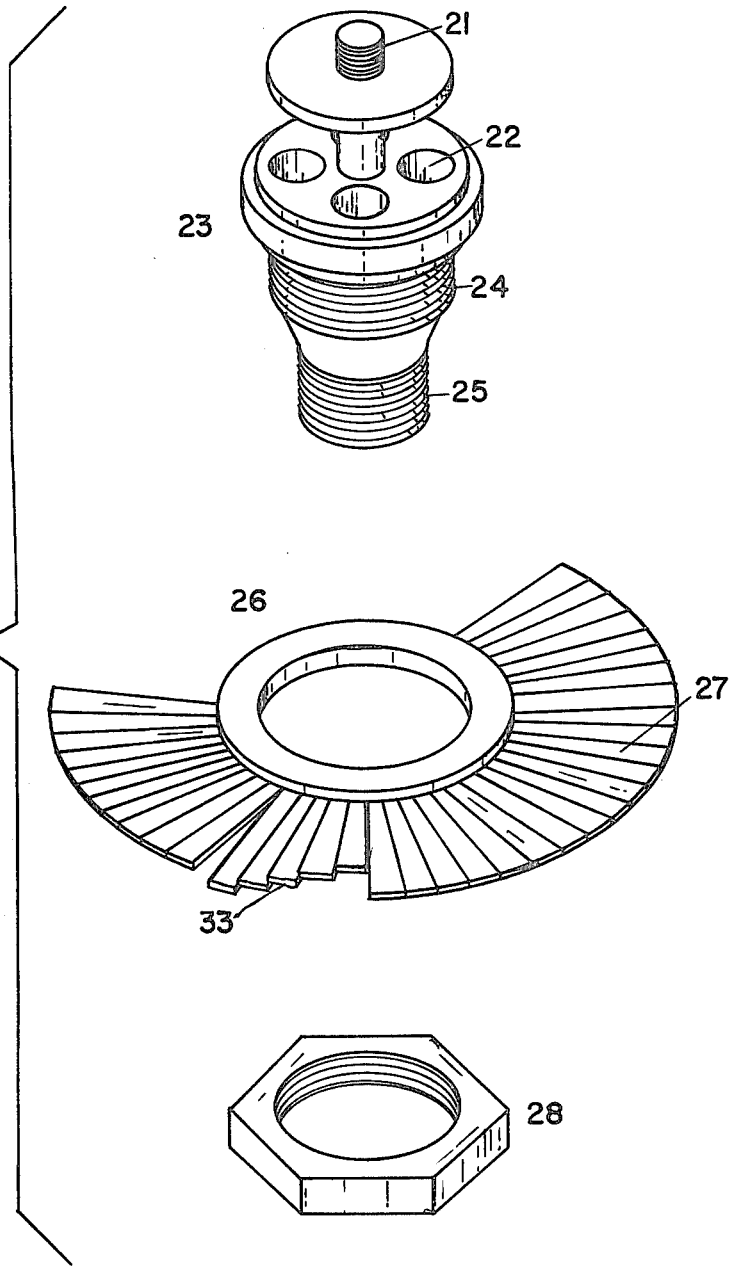
Figure 3:
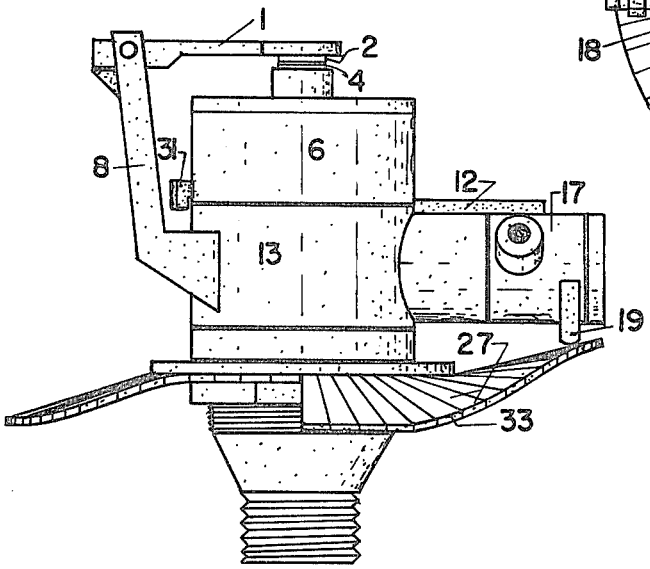
FIG. 3 is a side view of the device as shown on FIG. 2.
Figure 9:
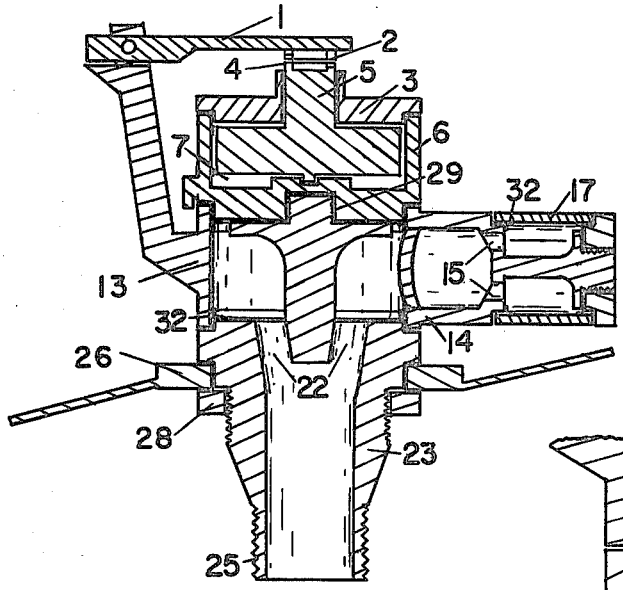
FIG. 9 is a cross-sectional side view of the device as shown in FIG. 2 and taken along section 9—9 of FIG. 2.

Referring to the drawings, in FIG. 1 attention should first be focused on the central hollow frame 23 with main features identified as; large water flow holes 22; threaded portion 24 cut to match with thread on nut 28 best illustrated in FIG. 1*a*. In the illustrated embodiment the nut 28 functions as a means to secure contour plate 26 firmly in position as illustrated in FIGS. 3 and 9. The threaded portion 25 is made to match external irrigation conduit and is only representative of an attachment means which must hold device firmly in a close to vertical position. The threaded portion 21 is made to match threaded portion 29, best seen in FIG. 9, at the base of buffer housing 6, which together are meant to represent a means for firmly securing buffer housing 6 to the central hollow frame 23 as shown in FIG. 3 and best illustrated in FIG. 9.

The hollow rotary unit 13 fits into and over the top of the central hollow frame 23 and is positioned under the buffer housing 6 as shown on FIGS. 3 and 9.

Figure 4:
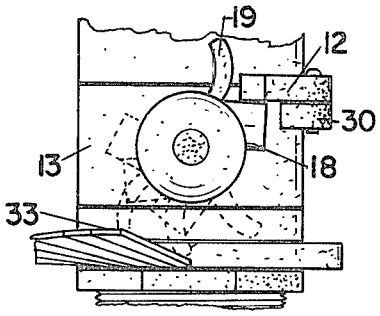
FIG. 4 is a partial side view of the device as shown in FIG. 3 depicting the rotation of the nozzle as it would occur at the end of the irrigation face. Dashed lines show contact leg and nozzle rotations until restrained as shown.
Figure 5:
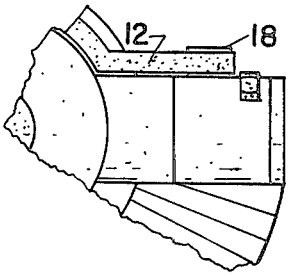
FIG. 5 is a partial plan view of the device showing the final condition of the rotation depicted in FIG. 4 and is representative of the relative nozzle position while restrained and circling back to the irrigation phase commencing position.
Figure 7:
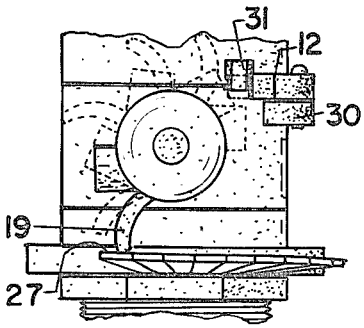
FIG. 7 is a partial side view of the device showing the nozzle rotation as it occurs instantly after derestrainment. Illustrated is the irrigation commencing position of the leg.
Figure 8:
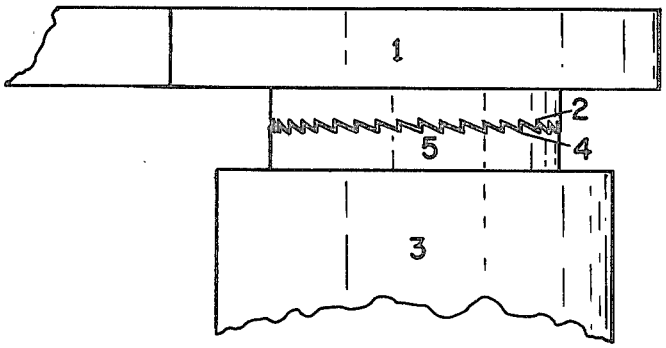
FIG. 8 is an enlarged partial view showing the upper section of FIG. 3 illustrating in greater detail a one directional toothed connecting means between the torque buffing impeller and its connector.
Figure 10:
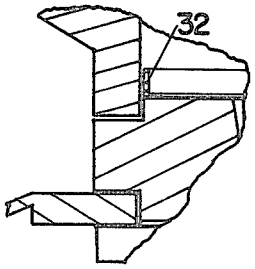
FIG. 10 is an enlarged partial view of the device as shown in FIG. 9 illustrating a typical seal location and possible design.

The lower portion of the buffer housing 6 fits loosely on the rotary unit 13, thereby rendering the rotary unit 13 capable of free rotation about a central axis. Water seals 32 are to be positioned as depicted in FIG. 9 and FIG. 10, with a typical embodiment shown on FIG. 10. The hollow rotary unit 13 is illustrated as a one piece unit comprising of a nozzle positioning shaft 14; a nozzle rotation restrainer seat 30 best visible in FIGS. 4 and 7; and a supporting arm 8 which is used to support the torque buffer connector 1. A pin-cotter pin unit 9 indicates a means to secure the torque buffer connector 1 to the supporting arm 8 in a manner that prohibits lateral motion but permits free vertical pivoting. Additional features are the small water flow holes 15 at the end of the nozzle positioning shaft 14; and the threaded portion 16 which is made to couple with the round nozzle nut 20, which is in turn used to secure the rotary nozzle 17. The rotary nozzle 17 contains, in the illustrated embodiment, a contact leg 19, an orifice cylinder 18 and seals 32 as illustrated on FIG. 9. The tip of the contact leg 19 rides during irrigation on the contour surface 27, thereby providing the necessary rotation of the nozzle. The orifice cylinder 18 serves as the aperture through which water is delivered to the exterior in the form of an irrigation jet. Attached to the rotary unit 13 is also the nozzle rotation restrainer 12 on which a spring 10 is located as shown in FIG. 7. The nozzle rotation restrainer 12, as shown in the preferred embodiment, rests on top of the nozzle rotation restrainer seat 30 and is secured firmly to it by a small bolt 11 threaded at its end. The bolt 11 screws into the seat 30 far enough to secure restrainer 12 from any movement other than a horizontal pivoting motion, at the same time the spring 10 maintains the restrainer 12 pivoted close to the rotary nozzle 17 as best seen on FIGS. 2 and 5. Associated with the nozzle restrainer 12 is an extension of buffer housing 6, designated as the sweep angle control 31. A rotating member, the torque buffing impeller 5 fits into the buffer housing 6. A pertinent feature of this element is the toothed ring 4 located at the top of its shafted portion. These interact with a mirror image toothed ring 2 cut in the underside of the torque buffer connector 1. These elements make up the clutch means preferred by the inventor but is not to be read to be limited to this embodiment. These are clearly depicted in FIG. 8 and are designed to operate as a clutch. The perforated sealing cap 3 pressed or screwed on the top of the buffer housing 6 fits around the top portion of the impellers as best illustrated in FIG. 9. A closed cavity 7 is formed inside the housing 6 containing the lower portion of the impellers and buffing matter, (for example, a dense low viscosity fluid).

Figure 2:
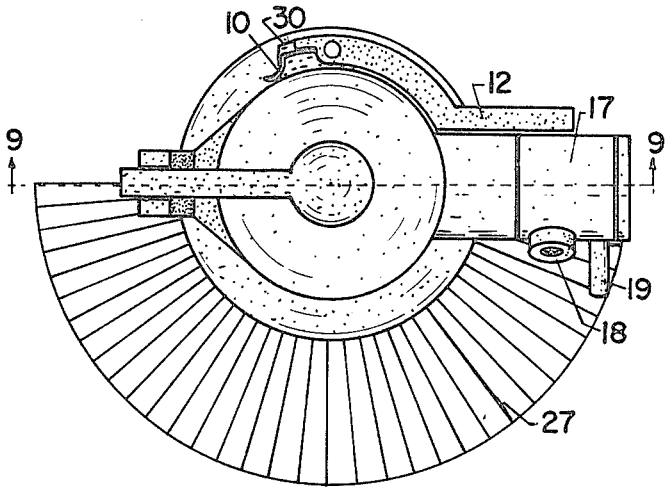
FIG. 2 is a plan view of the device as it would appear when using a contour plate of 180 degree maximum sweep. The view shows the device a few seconds before ending its irrigation phase.

To further understand the manner in which the device works and the functional relationships between the elements defined attention is invited to FIG. 9. Water is pumped into the central hollow frame via a water conduit attached to threaded portion 25. It then travels up the central hollow frame 23, flows through large water flow holes 22 and is funneled into the hollow rotary unit 13. The water then flows through the small flow holes 15 and enters the inside of the rotary nozzle 17 wherefrom it is discharged through the orifice cylinder 18 in the form of an irrigation jet. See FIG. 1 for best illustration of the orifice cylinder 18. This irrigation jet is accompanied by a force of reaction. A small portion of this force is utilized to provide a small constant torque in the rotary nozzle 17. This torque keeps the end of the contact leg 19 down against the contour surface 27 during the irrigation phase of the cycle. This small rotary torque is achieved by positioning the orifice cylinder 18 in a manner such that its central axis, also the line of force, does not intersect but is rather slightly away from the axis of rotation of the nozzle 17. Visually this offset nozzle can best be understood by the nozzle 17 illustrations in FIG. 7. The rotative torque induced in the nozzle 17 will be acting in a counter clockwise direction when viewing the device as seen in FIG. 7. The greatest portion of this force of reaction is acting to cause rotation of the hollow rotating unit 13 along with all of its attached elements. At the stage depicted in FIG. 2, this rotation is counterclockwise. FIG. 2 depicts the device as it would appear a few seconds before the end of a 180 degree counterclockwise irrigation sweep. For purposes of illustration a 180 degree contour plate is used. It is the intention of the inventor for contour plates varying in form a small angle up to a full 360 degrees to be used. FIG. 1*a* shows a contour plate 26 of approximately 130 degrees. The embodied contour surface is constructed of a flat circular plate with a circular section removed at its center. The diameter of said removed section being such that the plate will fit snugly around the central core 23 in a horizontal position and is held in place by a nut 28 which is screwed on the central core 23 thereby holding the contour plate 26 pressed between it and a flanged section of the central core 23. This condition is best illustrated in FIG. 9. The outer portion of the flat plate, being thinner is cut into a series of side by side radial elements 33, see FIG. 1*a*. each capable of having its free end bent vertically upwards or downwards thereby in unison providing a stepped contour surface 27.

The rotation caused in the hollow rotary unit would be relatively fast if unrestrained. A means is disclosed for reducing the same. This means embodies a clutch means whereby the hollow rotary unit freely rotates in one direction but is restrained or dampened in the other direction, or alternatively, the damping means can be engaged or disengaged in any direction. At the stage illustrated in FIG. 2, as well as during the entire irrigation phase of a cycle, the rotary motion of the hollow rotary unit 13 is controlled to a slow uniform rotation with a torque buffing mechanism, an explanation of which follows. On the supporting arm 8 is mounted the torque buffer connector 1, (FIGS. 1, 3 and 9), which in turn has its other end resting against the top of the torque buffing impellers. The contact point between the latest torque buffer connector and the impeller is a set of opposing toothed rings, ring 2 and 4, FIG. 8 which act as a clutch. It then follows, that as the rotary core 13 rotates, so does the supporting arm 8 and so does the buffer connector 1, as they are attached to the arm 8. This rotation is in unison about a same central axis, which is perpendicular to and passing through the toothed ring surface 2 of the torque buffer connector 1 and the toothed ring surface 4 of the torque buffing impellers. The teeth are cut in a manner such that no mutual slippage occurs during the irrigation stage of the cycle, see FIG. 8. This forces the torque buffing impeller 5 to rotate along in unison with the rotary unit 13. The torque buffing impeller, as described previously, has its lower portion enclosed along with the buffing matter inside the buffer housing 6. The turning of the impeller 5 is hampered by virtue of the dense low viscous fluid comprising the buffing matter which induces an opposite torque in the system anytime the impeller 5 is turned and thereby the sweeping action of the jet is slowed as desired.

From the previous discussion one recognizes that the angular velocity at which the rotary unit 13 functions is reduced, but movement is not stalled or restricted by the buffing means. The stronger the force induced by the irrigation jet the faster the rotation of the unit 13 will be. The irrigation jet will under normal operating conditions, induce a non-varying force. Changes in the reactive force can only be attributed to changes in the pressures at which water is being supplied. Yet, even though the reactive force remains the same the component of force which produces the torque for the rotation of the hollow rotary unit 13 is that which acts in the plane of rotation of said unit 13. In conclusion, a zero elevation angle of the jet would correspond to a small irrigation area, maximum turning force and maximum speed of irrigation sweep; a 45 degree angle of elevation corresponds to a large irrigation area, a revolution in turning force by a factor of 0.707, an increase in the friction between the rotary unit 13 and the central core to a factor of 0.707 times the reaction force times the coefficient of friction between the two, and a slower irrigation sweep. Thus described are the intrinsic properties of the device which achieve close to uniform irrigation throughout its sweep.

It is now expressed that the inventor has in no way restricted or intends to restrict the buffing mechanism previously described, to the embodiment described. It is further expressed that the described embodiment of the buffing mechanism is believed to be the simplest and most practical for the intended purpose. Yet, for example, the use of a fluid type matter could be substituted with a semi solid or solid matter with a high degree of plasticity and the impeller could be replaced with any element which when enclosed in the buffing matter would react with a similar counter rotative torque.

Figure 6:
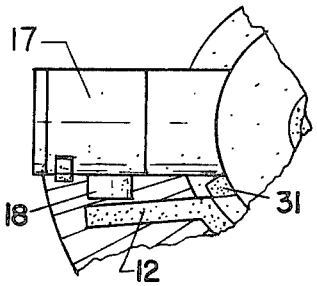
FIG. 6 is a partial plan view of the device illustrative derestrainment of the nozzle as would occur once it has been returned to the irrigation commencement position.

Attention is now invited to FIG. 2. At the stage represented, rotation is counterclockwise, the contact leg 19 is riding the contour surface 27 and the elevation angle of the irrigation jet is being determined by the rotative movements of the rotary nozzle 17, produced when said leg 19 is forced to move vertically in order to conform to the changes in contour being encountered. When the leg 19 has moved far enough to ride off the surface 27, or the surface 27 is sufficiently lowered, the rotary nozzle 17 quickly rotates until the orifice cylinder 18 encounters the nozzle rotation restrainer 12. These motions are best illustrated on FIGS. 4 and 5. The irrigation jet now reversed induces movement of the rotary unit 13, along with all its parts, in the opposite direction. Quick reverse rotation of the units is possible since the toothed connection between the impellers and the buffer connector 1 allows for unrestricted reverse movement. See FIG. 1 for details on the one way connection. Reverse rotation is continued until the nozzle rotation restrainer 12 collides with the sweep angle control 31 whereby rotation is immediately stopped and the nozzle rotation restrainer 12 is slightly pivoted as shown in FIG. 6. Subsequently, the rotary nozzle 17 no longer restrained at the orifice cylinder 18, rotates freely until the contact leg 19 encounters the contour surface 27 and the irrigation phase begins. The nozzle restrainer is forced back in position by the spring 10. These steps are best illustrated in FIG. 7.

Attention is now directed the method used in restraining the rotary nozzle 17 during its return stage. In the previous discussion, the restrainment occurred at the orifice cylinder 18. It is the desire of the inventor to express that the only thing required is the restrainment of the nozzle, furthermore the embodiment illustrated only represents the arrangements which the inventor believes best. Furthermore, the use of a torque buffing mechanism is not to be restricted only to the device when a rotary nozzle is used in conjunction with a contour plate. The buffing mechanism operates independently of these and could be used as well in a device with a fixed nozzle as long as it is positioned in the manner described.

The embodiments of the invention shown and described in full are to be considered only as the inventor's best concepted arrangement. There is no intention to thereby limit the invention to the details of such embodiments. On the contrary, the invention is to cover all modifications, alternative embodiments, usages and equivalents of the controlled thrust, rotary, adjustable topography sprinkler as fall within the spirit and scope of the invention, specification and appended claims.

What is claimed is:

1. A rotary irrigation device comprising, a hollow cylindrical frame, a hollow rotary unit coaxially placed on said frame whereby said frame acts as an axle shaft for said hollow rotary unit, a nozzle positioning shaft radially attached to said hollow rotary unit, a rotary nozzle rotatingly mounted on said nozzle positioning shaft unit, said nozzle further comprising at least one irrigation jet orifice, oriented so that the central axis of said irrigation jet orifice is substantially non-parallel to and non-intersecting with the axis of rotation of the hollow cylindrical frame thereby causing a rotary torque on the hollow rotary unit and inducing a rotary motion, said irrigation jet orifice further oriented so that the direction of flow is not along a radius of the axis of rotation of said rotary nozzle, thereby utilizing a small portion of the induced resultant force of the irrigation jet to produce a rotary torque on the rotary nozzle, an adjustable contour surface mounted concentrically on said hollow cylindrical frame, for providing adjustable cam means, a contact leg positioned on the outer surface of said rotary nozzle, for providing cam follower means, said leg urged to bear against said contour surface by the rotary torque appearing in said nozzle.

2. In the device of claim 1, said adjustable contour surface further comprising a plurality of adjacent radially positioned narrow arms capable of having their outer portions positioned up or down as desired for producing a stepped contour surface.

3. In the device of claim 1, said rotary irrigation device further comprising, an irrigation sweep angular velocity control torque buffing device.

4. In the device of claim 1, said contact leg proportioned to bear against said contour surface only when said surface is horizontally or upwardly disposed so that positioning a portion of said contour surface downwardly causes said contact leg to disengage from said contour surface, causing said rotary nozzle to rotate about its axis until stopped by rotation-stopping restraining means.

5. In the device of claim 4, means for restraining the rotary nozzle in a reversed position during returning stage to allow the induced force of the irrigation jet to quickly rotate rotary unit in a reversed direction, means for stopping the reversal motion of the rotary unit, means for freeing reversed restrained nozzle once returned to irrigation commencing position.

6. In the device of claim 3, said irrigation sweep angular velocity control torque buffing device comprising, a buffer housing coupled to said central hollow frame, said buffer housing containing buffer matter, a rotating member contained in said buffer housing whereby said rotating member is in contact with said buffing matter, said rotating member in a clutched relationship with said hollow rotary unit, whereby the angular rotation of said hollow rotary unit can be alternatively maintained at a relatively slow constant velocity, or be totally unrestrained and undamped.

7. A method for irrigating variable geometry areas comprising the steps of;

pumping a liquid through a hollow cylindrical frame, deviating the flow of said liquid through a nozzle positioning shaft rotatingly mounted on said frame, funneling said liquid through the nozzle positioning shaft and into a rotary nozzle, discharging said liquid from an irrigation jet orifice on said rotary nozzle, rotating said nozzle positioning shaft with the torque provided by the discharge of said liquid, rotating said rotary nozzle with the torque provided by the discharge of said liquid, urging a contact leg attached to said rotary nozzle to bear against an adjustable contour surface so that disengagement of said leg with said surface and the concomitant rotation of said rotary nozzle is caused by a depression in said contour surface, restraining said rotary nozzle so that said nozzle assumes a reversed position when said rotary nozzle has disengaged from said contour surface, allowing quick reverse rotation of the nozzle positioning shaft with a clutch device which disengages when said contact leg disengages from said contour surface, freeing said reversed restrained nozzle from its reversed position when said nozzle positioning shaft has returned to its preselected irrigation commencement position in response to the torque provided by the discharge of said reversed nozzle so that said contact leg of said rotary nozzle is free to rotate until it re-engages said contour surface, damping the rotation of the nozzle positioning shaft with a torque buffing device.

* * * * *